United States Patent [19]

Chiappetti

[11] 4,340,211

[45] Jul. 20, 1982

[54] ADJUSTABLE VEE BLOCK CLAMP

[76] Inventor: Pietro Chiappetti, 5341 Hawley Ave., Los Angeles, Calif. 90042

[21] Appl. No.: 171,727

[22] Filed: Jul. 24, 1980

Related U.S. Application Data

[63] Continuation-in-part of Ser. No. 19,094, Mar. 9, 1979, abandoned.

[51] Int. Cl.[3] ..... B25B 1/20; B25B 1/24

[52] U.S. Cl. ..... 269/110; 269/154; 269/156; 269/272; 269/286; 269/902

[58] Field of Search ..... 269/902, 272, 110, 152, 269/154, 155, 156, 273, 279, 286; 90/DIG. 17, DIG. 18

[56] References Cited

U.S. PATENT DOCUMENTS

| | | |
|---|---|---|
| 272,995 | 2/1883 | Whitney . |
| 400,116 | 3/1889 | Roberts . |
| 743,729 | 11/1903 | Kirk . |
| 1,372,661 | 3/1921 | Secord . |
| 1,923,967 | 8/1933 | Brown, Jr. |
| 2,352,885 | 7/1944 | Bukowsky . |
| 2,764,047 | 9/1956 | Allbritton . |
| 3,633,900 | 1/1972 | Olson . |
| 3,982,740 | 9/1976 | Gutman . |
| 4,139,189 | 2/1979 | Wietrzyk . |

FOREIGN PATENT DOCUMENTS

| | | |
|---|---|---|
| 462515 | 9/1943 | France . |

*Primary Examiner*—Robert C. Watson

*Attorney, Agent, or Firm*—Fulwider, Patton, Rieber, Lee & Utecht

[57] ABSTRACT

A vee block clamp is provided intended chiefly to hold items having a curved outer surface. The clamp comprises a plurality of clamping blocks with oppositely facing inclined edges cooperating to define a vee shaped support surface. The dimensions of the support surface are adjusted according to the size of the item to be supported by longitudinally sliding the clamping blocks toward and away from each other. The clamping blocks are constrained for horizontal sliding motion only so that the blocks are prevented from rotating relative to each other.

20 Claims, 14 Drawing Figures

ADJUSTABLE VEE BLOCK CLAMP

BACKGROUND OF THE INVENTION

This is a continuation-in-part of copending application Ser. No. 019,094, filed Mar. 9, 1979, now abandoned.

This invention relates to a work holder for holding a workpiece upon which metal and wood working are to be accomplished.

In order to accomplish many mechanical operations in workshop practice, it is essential that an item to be worked upon is held fixed in an accurately located position. Clamps having flat jaws and screw thread advances are widely used to hold items having rectangular configurations, but these types of clamps pose several problems when they are used for holding items having curved surfaces. Chiefly, the flat jaws cannot engage the curved surface item over a large surface area of the item. Thus, the force that the jaws exert to hold the item is concentrated over a small surface area. This force concentration can cause deformation or destruction of the item to be held. Further, the limited area of surface contact may be insufficient to give the clamp an effective hold on the item.

Clamps of the type shown in U.S. Pat. No. 743,729 to Kirk which use jaws with inclined gripping faces are better able to hold items with curved surfaces. Although satisfactory for its purposes, the device disclosed in Kirk uses an elaborate assembly including a work support plate, vee blocks, bolts, and levers to position and secure the blocks in position because it was intended for use in the bed of a lathe. The Kirk device was not intended to be used as a free standing clamp. The bar in the Kirk device to support the top of the item appears intended to have a location fixed within the range of the nuts holding it atop the clamp, and thus the bar cannot be significantly adjusted to various heights. Further, the clamp in Kirk is constructed so that the side blocks are a fixed distance apart and therefore the central block can be only one size. Finally, the Kirk device requires a number of bolts to be tightened to lock the vee blocks in place.

When prior art vee block devices are used, the operator must insert or remove shims under the device to change the vertical location of the device and the item held. Inserting and removing shims is time consuming and increases the cost of setting up a machine operation.

From the foregoing, one can see that there has existed a need in the prior art for a simple clamp for holding curved items which is easy to operate and inexpensive to make. A desirable clamp would be free standing, provide for quick adjustment of the vertical height of the clamped item, accommodate a wide range of shapes and sizes of the items and would permit fast and accurate closing of the clamp's item gripping surfaces.

SUMMARY OF THE INVENTION

A vee block clamp according to the invention provides an inexpensively fabricated clamping device for holding items that have curved surfaces. The device is intended for use in holding items upon which mechanical operations are to be performed. The clamp includes a plurality of vee blocks which are quickly and easily adjustable to allow the operator to quickly and accurately select the desired vertical location of the item without shims. In one embodiment a channel arrangement between the vee blocks provides simple and accurate horizontal sliding alignment of the blocks without extensive framework and allows a central block of the clamp to act as a guide for sliding motion of side blocks of the clamp. In another embodiment, horizontally elongated slots are provided in the blocks in alignment with each other for reception of a threaded fastener having a rectangular shank sized to prevent rotation of the blocks with respect to the fastener, and thereby restrain the blocks to horizontal sliding motion.

In one preferred embodiment, the vee block clamp comprises a central block having an inclined edge facing toward a front end of the tool, and opposite parallel and substantially planar sides each interrupted by a horizontal channel. Lying adjacent the respective sides of the central block are a pair of side blocks. Each side block has an inclined edge facing toward a rear end of the tool, so that the inclined edges of the central block and the side blocks define an upwardly presented vee shaped support surface. The side blocks are held in proper orientation by a horizontal projection that extends from one side wall of each side block and which engages the adjacent channel in the central block. The channels and projections cooperate to form a tongue and groove configuration to allow the central and side blocks to slide horizontally against each in order to change to location and size of the vee shaped support surface, but they prevent the blocks from rotating out of horizontal alignment with respect to each other.

The blocks can be held locked in position by a threaded fastener which can be manually operable with a knurled knob. The fastener passes through one bore in one side block, through an elongated slot in the central block, and finally engages into a threaded bore in the remaining side block. The elongated slot in the central block allows an operator to fix the clamp over a wide range of adjustment positions because the blocks can be slid into an infinite range of positions. By adding extra bores and threaded bores in the side blocks, one set on each side of the central hole described above, the spread of the clamp can be increased. After the operator slides the blocks apart or together to achieve the desired vee size, he clamps the blocks together with the threaded fastener. The item to be held is secured in the vee-shaped support surface by means of a top arm which the operator clamps against the uppermost extent of the item wherein the top arm is held in position with screw devices joining the top arm to the central block.

A significant improvement provided by the invention is the lowered cost of producing a fixture having relatively short set up time. The screw fastening of sliding blocks allows the operator to manually adjust the size of the vee shaped support surface and to thereupon lock the blocks together. In instances where height positioning is important, the lower side of the top arm can be adjusted into place, whereupon the item can be placed between the blocks and the blocks pushed together until they reach the position where the item rises on the vee block edges to engage the top arm. The operator can then lock the blocks fixed in this position with the threaded fastener.

The invention can be used either as a single unit or used in pairs. When the item to be held is small or the force to be applied to the item by the working tool is slight, one unit is sufficient. When it is desired to hold very small items, a central block having a lesser thickness can be used so that the two side blocks engage the item with less gap between them.

In another preferred embodiment of the invention, a plurality of relatively thin clamping blocks each having an inclined edge are arranged in a side-by-side laminated stack. The blocks are arranged in the stack with their inclined edges facing alternately in front and rear directions to define the vee shaped support surface. The blocks each comprise a horizontally elongated base with an elongated and relatively narrow slot formed therein. At least one threaded fastener is received through the slots of the several blocks in the stack, and this fastener includes a shank of noncircular cross section to prevent rotation of the blocks relative to the shank and relative to each other.

In one form of the invention, the clamping blocks of the laminated stack can be selected from a variety of materials to include both relatively hard blocks formed from stainless steel or the like, and relatively soft blocks formed from aluminum or the like. The horizontal bases of the respective hard and soft blocks may be sized appropriately to have different lengths whereby the plurality of blocks can be horizontally adjusted to provide the vee shaped support surface from the hard blocks only or from the soft blocks only or from a combination of the hard and soft blocks.

Other features and advantages of the present invention will become apparent from the following detailed description, taken in conjunction with the accompanying drawings which illustrate, by way of example, the principles of the invention.

BRIEF DESCRIPTION OF THE DRAWINGS

A clamping apparatus constructed in accordance with the preferred embodiments of the invention is illustrated in the accompanying drawings in which.

DETAILED DESCRIPTION OF THE PREFERRED EMBODIMENTS

The invention comprises a clamp 9 which may be utilized to clamp a curved item or workpiece in a predetermined position, exposing a substantial part of the item so that work operations can be performed thereon. The clamp 9 is quickly adjustable to suit the item's shape. It can be quickly moved to the position required and it allows the operator to fast and accurately locate the item vertically without the use of shims. Once positioned, it can be operated to lock the item in place by a single operation. Its grip is sure and it can be adjusted to accommodate items of varying diameters and lengths.

Figure 1:
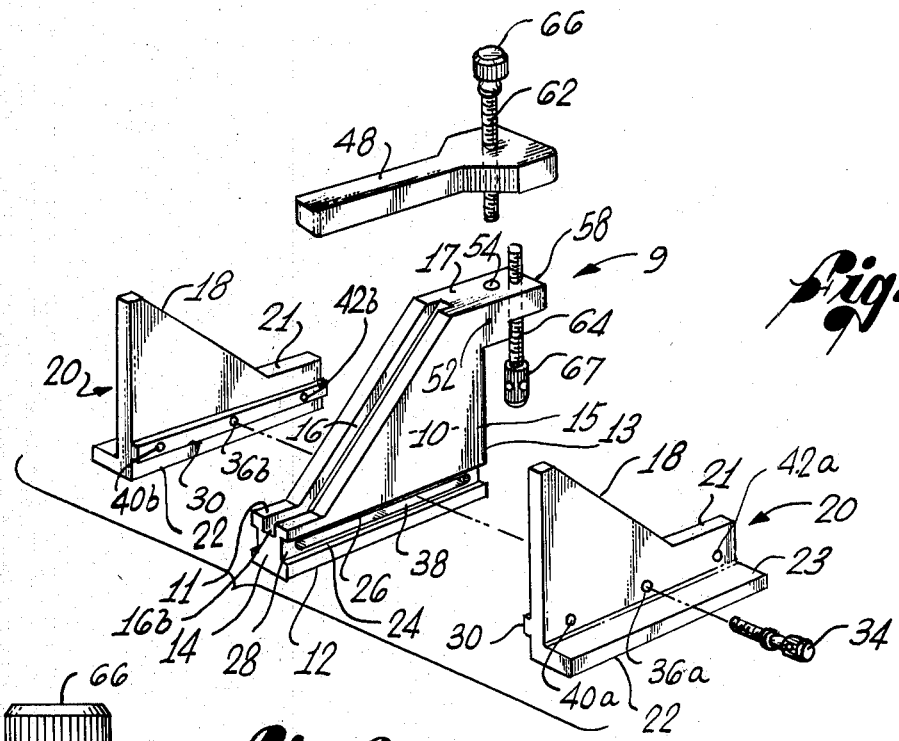
FIG. 1 is an exploded perspective view of one embodiment of the apparatus showing a central block flanked by two side blocks and depicting a top arm above the central block.
Figure 3:
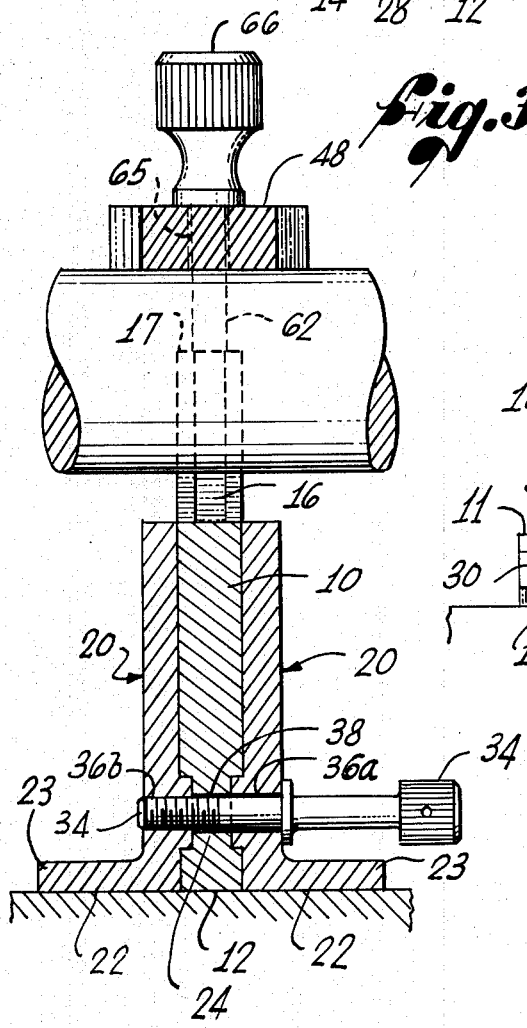
FIG. 3 is a cross sectional view taken along line 3—3 in FIG. 2 with the fastener holding the blocks together.

The structure which enables these results to be achieved includes a central block 10 to which the rest of the structure is attached. The central block is a rectangular solid having a planar flat horizontally extending base edge 12, designed to rest on the flat bed of a machine tool or on a flat bench. To simplify description of the clamp, one end of the clamp will be called the front end, depicted generally as 14 in FIG. 1, and the other end will be called the back end 15. At the front end of the clamp 9, above the base edge 12, is a horizontal lower shelf 11 of the central block. This lower shelf 11 is capable of supporting the weight of any item which might locate in the clamp. Extending upwardly and rearwardly from the rear end of the front shelf 11 is the inclined work supporting edge 16 of the central block 10, which is the principal item positioning and supporting element of the clamp 9. The inclined work supporting edge 16 rises rearwardly to a position where it intercepts a top shelf or upper edge 17 of the central block 10. In the embodiment depicted in the drawings, the intersection of the top shelf 17, which defines the upper limit of the central block, and the inclined work supporting edge 16 is located nearly vertically above the back end 15 of the central block 10, although the location of the intersection is determined by the height of top shelf 17. Further in the depicted embodiment, a groove **16*b* is channeled into the inclined edge to allow a drill or other machine tool to cut through the surface of the item held without cutting the surface of the block. The third side of the triangular portion of the central vee block 10 is a back edge 13 which in the embodiment depicted rises generally vertically from the base edge 12**.

Work held in the clamp 9 lies between the inclined edge 16 of the central block 10 and inclined work supporting edges 18 of two side blocks 20 which lie adjacent to and in abutting contact with the adjacent side surface of the central block. The inclined edges 18 of the side blocks 20 face the back end 15 of the device and these inclined faces intercept and form an angle with the inclined face 16 of the central block 10. The side blocks 20 also themselves comprise generally rectangular solid bodies with flat horizontally extending base edges 22 in the same plane as the base edge 12 of the central block 10 which allow them to rest on the same surface as and adjacent to the base edge 12 of the central block 10. Each side block 20 has a lower horizontal shelf 21 at its rearward end which is approximately the same height above the base as is the lower shelf 11 of the central block 10 and which like the lower shelf 11 of the central block 10, can act to support the item to be held.

Figure 2:
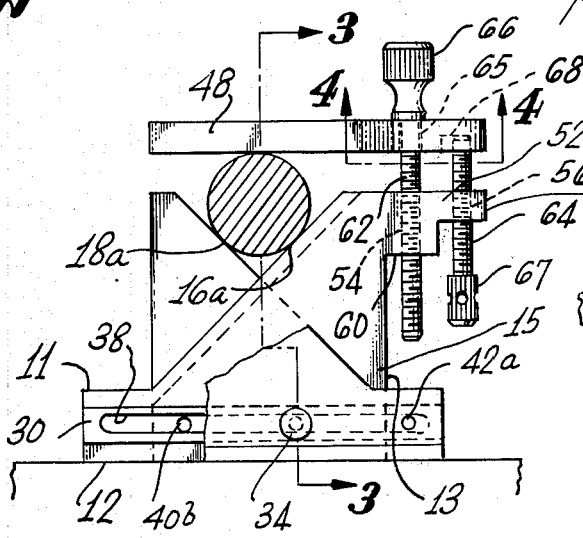
FIG. 2 is a side elevational view showing a slot and a fastener joining the blocks and a screw mechanism joining the top arm to the central block.

Each side block 20 at its lower end has an outwardly extending flange 23 which provides stability to the clamp structure as it rests on an underlying surface such as a work bench or the bed of a machine tool. The flanges can be supported by clamps to secure the clamp 9 onto its underlying surface and may be provided with openings (not shown) to enable the flanges to be bolted down. The inclined edges 16 and 18 of the central block 10 and the side blocks 20 intercept each other as is illustrated in FIG. 2 in such a way to define an upwardly presented vee shaped support surface upon which the item is supported in the clamp in two locations, one on the central block as illustrated at 16*a*, and another on each of the side blocks as illustrated at 18*a*.

Alignment of the side blocks 20 with the central block 10 is accomplished by means of a generally horizontal channel 24 on each side face 26 of the central block. A longitudinal projection 30 extending from an inside face 32, the one facing the central block 10, of each side block 20 engages into the channel 24 in one face of the central block 10. The longitudinal projection 30 and the channel 24 act as a tongue and groove. While there is sufficient clearance between the projection 30 and the channel 24 to permit the projection to slide in the channel, the fit between the projection and channel is snug enough to hold the side block 20 in alignment with the central block 10.

The clamp 9 is held together by a manually operated threaded fastener 34. The fastener 34 used in the invention is a threaded rod which enters the clamp 9 through a smooth center bore 36*a* in one of the side blocks 20, passes through a longitudinally extending horizontal slot 38 extending transversely through the central block 10, and engages into a center threaded hole 36*b* in the other side block 20. The slot 38 is used in the central block 10 because it allows the fastener 34 and side blocks 20 to slide along the central block 10 thereby making various clamp opening sizes possible. The range of clamp openings is even further increased by two additional sets of holes in the side blocks 20, one set of bores 40*a* and 40*b* to the left of the bores 36*a* and 36*b*, and one set of bores 42*a* and 42*b* to the right of the central bores 36*a* and 36*b*. By locating the fastener in the right bores 42*a* and 42*b*, the blocks can be arranged with the inclined edges 16 and 18 spread far apart to accommodate bulky items. By locating the fastener in the left bores 40*a* and 40*b* the blocks can be positioned to accommodate smaller items and to support the work in a higher vertical position above the base 12.

While the clamp 9 will probably most frequently be used for holding items having a circular cross section, the clamp is constructed so that it can also hold items having curved sides or sides having a cross section other than circular. When items are held in the clamp 9, the item rests on the inclined work supporting edges 16 and 18 of the central block 10 and the side blocks 20 as is shown in FIG. 2. The item may also be allowed to rest on lower shelves 11 and 21 of the blocks 10 and 20 when the blocks are widely spread.

Work is held inside the clamp 9 and against inclined edges 16 and 18 by an adjustable top arm 48, extending from the central block 10. The top arm 48 extends over the top surface of the item to be held and can be adjusted to hold the item fast against the inclined surfaces 16 and 18. The top arm 48, an elongated rectangular piece, lies adjacent to the horizontal top shelf 17 of the central block 10. This top shelf 17 extends from a point of intersection with the inclined edge 16 toward the rear end 15 of the clamp 9. A portion 52 of the upper edge 50 projects out over a back vertical edge 54 of the central block 10. In this projection 52 are located threaded holes 54 and 56 into which top arm 48 adjusting and locking screws engage, as will shortly be described. While the projection 52 requires no particular shape for its bottom surface, in the embodiment depicted, the thickness of an outermost edge 58 of the projection 52 is stepped down by a reverse step 60. The step 60 allows a shorter adjustable screw to be used to extend through the projection 52.

Figure 4:
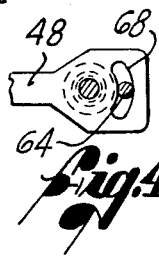
FIG. 4 is a view taken along line 4—4 in FIG. 2 showing a curve groove which allows the top arm to extend over work in positions departing from a central line.

The top arm 48 is connected to the central block 10 by two threaded fasteners. To position the top arm 48, the operator turns an adjusting screw 62 that can adjust the top arm 48 to the desired height. This adjusting screw 62 passes first through a smooth hole 65 in the top arm 48 and then engages the adjusting screw threaded hole 54 in the projection 52. As the adjusting screw 62 is turned by the operator, the vertical position of the top arm 48 varies. When the desired position is achieved, the operator locks the arm into position using a locking screw 64. The locking screw extends upward through a locking screw threaded hole 56 in the projection 52 and contacts the lower surface of the top arm 48. Knobs designated by numerals 66 and 67, respectively, are attached to adjusting screw 62 and locking screw 64 to make adjustment of the screws more easily accomplished. Because it may be necessary or desirable that the top arm 48 be locked in position other than along a line parallel to the front-rear axis of the central block 10, a circular groove 68 is located in the bottom of the top arm 48. As is shown in FIG. 4, the groove 68 allows the locking screw 64 to engage the top arm 48 over an arc-like range of engaged positions.

Figure 5:
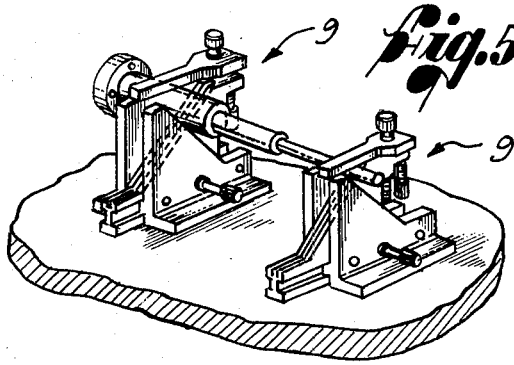
FIG. 5 is a perspective view illustrating the use of a pair of the clamps to hold relatively long work having different outside diameters.

The novel clamp 9 can be used singly to hold items or it can be used in pairs as is illustrated in FIG. 5 to hold long items or items needing additional support. Whether the blocks are used singly or in pairs, items having a cross sectional area that is uniform throughout the area of the item that is in the clamp 9 can be held between the central block 10 and side blocks 20 and work operations can be conducted on that portion of the work resting over the central block.

From the foregoing it will be appreciated that the present invention provides a clamp for holding items having curved sides between three adjustable blocks whose inclined edges both hold and position the item. Channels and projections on the blocks hold the blocks in alignment, and the screw threaded fastener can quickly lock the clamp in position. The clamp provides to the operator an ability to accurately locate the item with an inexpensive device and without using shims. The clamp can also hold items that have cross sectional areas which are irregular or discontinuous.

An alternate embodiment of the invention is illustrated in FIGS. 6–14. As shown, a clamp 70 comprises a plurality of relatively thin clamping blocks 72 and 74 arranged in a laminated stack and configured to define an upwardly presented generally vee shaped support surface 76. These blocks 72 and 74 are designed to rest upon a flat horizontal surface 78 of a bench or machine bed and are adjustable for defining the support surface 76 to have an appropriate shape and vertical position for supporting a work piece (not shown) in a convenient position for the performances of work thereon.

The clamping blocks 72 and 74 each comprise a generally triangular body 86 which extends upwardly from a generally rectangular base 84. Importantly, as shown, the blocks 72 and 74 are formed generally identical to each other with the exception that the bases 84 of the blocks 74 are slightly shorter than the bases 84 of the blocks 72, for reasons which will become apparent. However, for sake of clarity and ease of description, the blocks 72 and 74 will be described by means of common reference numerals.

The triangular body 86 of each block 72 and 74 is centrally positioned atop its respective base 84, and is defined by an upwardly angled inclined edge 88 forming a portion of the clamp vee shaped support surface 76. This inclined edge 88 is joined at its upper end to a relatively short horizontal shelf 90. In turn, the shelf 90 merges with a vertical margin 92 which extends downwardly to the base 84.

The blocks 72 and 74 are arranged in the laminated stack with their inclined edges 88 alternately facing in opposite directions to define the vee shaped support surface 76. The blocks 72 and 74 are retained in the stacked configuration by a fastener 96. More specifically, the base 84 of each clamping block 72 and 74 includes a horizontally elongated and relatively narrow slot 98 extending for a substantial portion of the length of the base. This slot 98 is interrupted along its length at the end thereof adjacent the vertical margin 92 by a circular enlargements 100 for passage of the fastener 96.

The fastener 96 comprises a shank 102 of a flattened cross section formed integrally between an enlarged head 104 and a relatively short threaded portion 106. When the clamping blocks 72 and 74 are arranged in the laminated stack and horizontally positioned with respect to one another to align the slot enlargements 100 in the bases 84, the threaded portion 106 of the fastener 96 is received through the aligned enlargements 100 for threaded reception into a nut 108. Then, the blocks 72 and 74 can be horizontally moved apart to increase the width of the support surface 76 and to cause the fastener 96 to slide along the slots 98 of the blocks.

The shank 102 of the fastener 96 is sized for relatively close sliding reception within the slots 98 of the clamping blocks 72 and 74 when the nut 108 is loosened. The noncircular cross section of the shank 102 serves to lock the blocks 72 and 74 against rotation with respect to each other, and to restrain the blocks for relative movement only in a horizontal direction when the nut 108 is loosened on the threaded portion 106. Thus, the blocks 72 and 74 can be moved with respect to each other to vary the size of the vee shaped support surface 76 according to the size of the item to be supported. Conveniently, since the slot enlargements 100 are positioned at the ends of the slots 98 adjacent the vertical margins 92, the blocks 72 and 74 can be moved horizontally a maximum distance away from each other with the fastener 96 slidally by supported in the slots 98.

Figure 6:
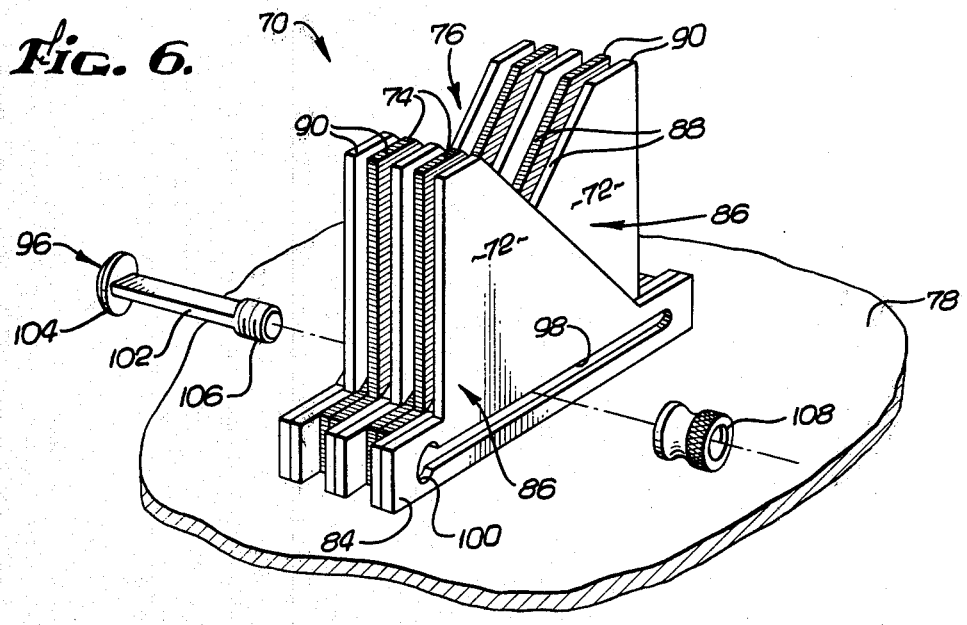
FIG. 6 is an exploded perspective view of an alternate embodiment of the apparatus showing a plurality of clamping blocks arranged in a laminated stack.

Similar to the embodiment of FIGS. 1–5, the clamp of FIG. 6 can be used in pairs for supporting relatively long items. However, for relatively short items, the clamp of FIG. 6 can be adjusted to support the item upon only a few of the clamping blocks 72 and 74. That is, any desired number of the blocks 72 and 74 can be horizontally withdrawn from the item being supported to remove any predetermined number of the inclined edges 88 from the support surface 76 to shorten the length of the support surface, and thereby tailor the length of the support surface according to the length of the item.

Figure 10:
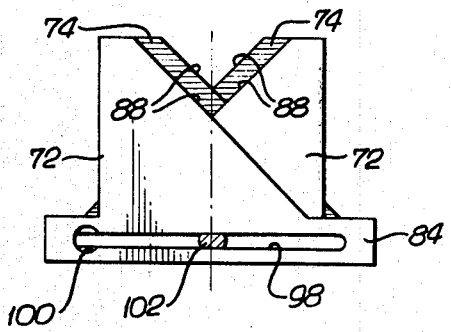
FIG. 10 is a front elevation view taken on the line 10—10 of FIG. 9.
Figure 9:
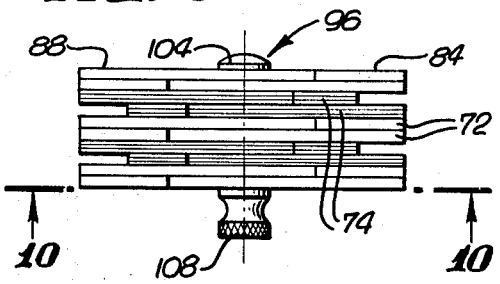
FIG. 9 is a top plan view illustrating the clamping blocks in the second position of adjustment.
Figure 14:
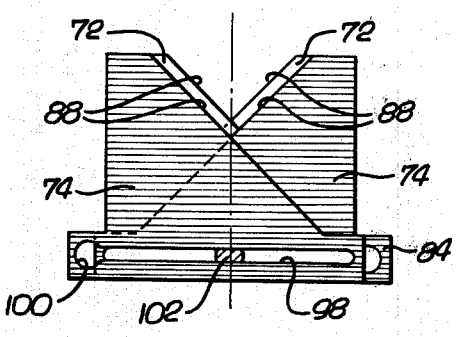
FIG. 14 is a vertical section taken on the line 14—14 of FIG. 13.
Figure 13:
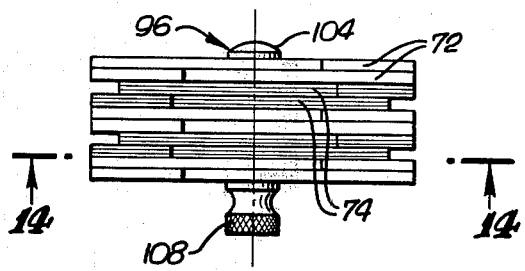
FIG. 13 is a top plan view illustrating the clamping blocks in the fourth position of adjustment.

The clamping blocks 72 are formed from a relatively hard material such as stainless steel. In contrast, the clamping blocks 74 are formed from a relatively soft material such as aluminum and are shown in shaded form in the drawings for purposes of clarity. As illustrated in FIG. 6, the two exterior blocks at each end of the stack both comprise the hard surface clamping blocks 72. Thereafter, across the length of the support surface 76 on each of the two sides thereof, the blocks 72 and 74 are alternately disposed to provide alterating support edges 88 formed from the hard and soft materials. With this arrangement, it is possible to orient the clamping blocks 72 and 74 with respect to each other to provide alternating hard and soft edges upon which to support the item or workpiece. If desired, the harder blocks 72 can be withdrawn horizontally from the support surface 76 to support the workpiece only by the edges 88 of the softer clamping blocks 74, as illustrated in FIGS. 9 and 10. Alternately, if desired, the softer blocks 74 can be withdrawn from the support surface 76 to support the workpiece only by the edges 88 of the harder clamping blocks 72, as illustrated in FIGS. 13 and 14.

The bases 84 of the clamping blocks 72 and 74 are formed to have different lengths to facilitate adjustment of the blocks horizontally with respect to each other. More specifically, as shown in FIG. 6, the bases 84 of the soft blocks 74 are formed to have a length shorter than that of the harder blocks 72. Thus, when a workpiece is positioned upon the support surface 76, the inclined edges 88 of the blocks 72 and 74 can be aligned with each other to form the support surface 76 as a combination of the harder blocks 72 and the softer blocks 74. Because the bases 84 of the softer blocks 74 are shorter than the bases of the harder blocks 72, the ends of softer blocks 74 terminate short of the ends of harder blocks 72 as illustrated in FIG. 6.

Figure 7:
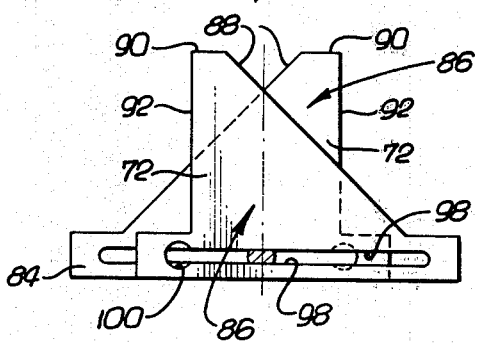
FIG. 7 is a side elevation view of the apparatus of FIG. 6 illustrating the clamping blocks in one position of adjustment.
Figure 8:
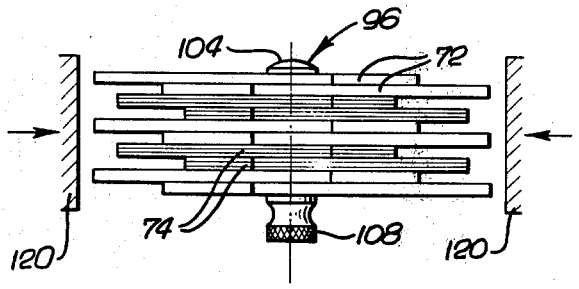
FIG. 8 is a top plan view illustrating movement of the clamping blocks to a second position of adjustment.

The blocks 72 and 74 can be quickly and easily adjusted to withdraw the edges 88 of the harder blocks 72 from the support surface 76 by sliding the bases 84 of the blocks relative to each other. More specifically, with the blocks 72 and 74 moved toward each other to form a relatively small vee-shaped support surface 76 as shown in FIGS. 7 and 8, the ends of the bases 84 of the harder blocks 72 project beyond the ends of the softer blocks 74. In this configuration, the ends of the bases 84 of the harder blocks 72 at the left-hand side of the clamp as viewed in FIG. 7 correspond with the edges 88 of the harder block 72 on the right-hand side of the support surface 76, and vice versa. By pushing inwardly on opposite ends of the blocks 72 and 74 as demonstrated by the push blocks 120 in FIG. 8, the inclined edges 88 of the harder blocks 72 are pushed away from the edges 88 of the softer blocks 74 yielding a support surface 76 comprised only of the softer blocks as shown in FIGS. 9 and 10. The distance by which the harder blocks 72 are withdrawn from the support surface is a direct function of the difference between the lengths of the bases 84 of the blocks 72 and 74.

Figure 11:
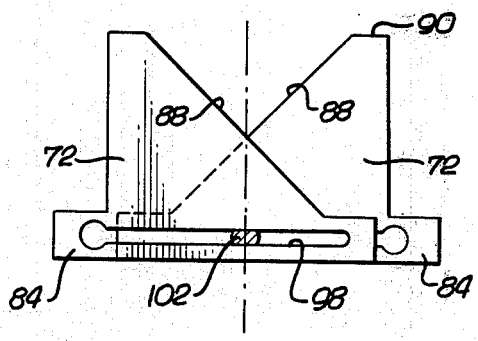
FIG. 11 is a front elevation view illustrating the clamping blocks in a third position of adjustment.
Figure 12:
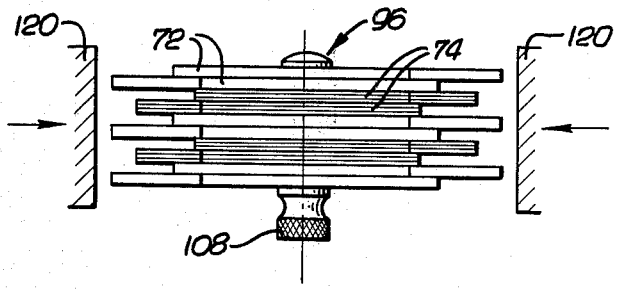
FIG. 12 is a top plan view illustrating movement of the clamping blocks to a fourth position of adjustment.

When the blocks 72 and 74 are moved away from each other to form a relatively large vee shaped support surface 76 as shown in FIGS. 11 and 12, the bases 84 of the harder blocks 72 once again project beyond the ends of the bases 84 of the softer blocks 74. However, in this configuration, the ends of the bases 84 of the harder blocks 72 at the left-hand side of the clamp correspond with the edges 88 of the harder blocks 72 on the left-hand side of the support surface 76, and vice versa. By pushing inwardly, on the opposite ends of the blocks 72 and 74 as demonstrated by the push blocks 120 in FIG.

12, the inclined edges 88 of the harder blocks 72 are pushed inwardly toward each other to form a support surface 76 comprised only of the edges 88 of the harder blocks 72, as shown in FIGS. 13 and 14. Again, the distance by which the harder blocks edges 88 are disposed from the edges 88 of the softer blocks is a direct function of the difference in the lengths of the bases 84.

The clamp of FIGS. 6∝14 is thus quickly and easily adjusted to form the vee shaped support surface 76 of a variety of sizes and shapes. The support surface 76 may be adapted to have a selected length and to be composed of the inclined edges 88 of hard surface clamping blocks 72 and/or the inclined edges 88 of the soft surface clamping blocks 74. As in the embodiment of FIGS. 1–5, a workpiece can be accurately located with inexpensive clamp components and without using shims. The clamp is further adapted for holding items with a variety of regular or irregular surface configurations.

While particular forms of the invention have been illustrated and described, it will be apparent that various modifications can be made without departing from the spirit and scope of the invention. For example, the slots 98 with enlargements 100 shown with reference to the embodiment of FIGS. 6–14 can be formed in the central block 10 and the side blocks 20 shown in FIGS. 1–5, with a threaded fastener 96 having a shank 102 of non-circular cross section being utilized to prevent relative rotation between the blocks 10 and 20. Accordingly, no limitation upon the invention is intended except by way of the appended claims.

What is claimed is:

1. Adjustable vee blocks for holding a workpiece comprising, a central block extending in a longitudinal direction with forward and rear ends having, flat, parallel side surfaces extending in a vertically and longitudinally extending plane, a horizontal, longitudinally extending base edge, a work supporting edge spaced above said base edge extending longitudinally in an upward and rearward direction, a longitudinally extending horizontal slot adjacent and parallel to said base edge extending transversely through said central block;

two side blocks positioned on opposite sides of said central block, each said side block having, a flat side surface in abutting contact with the adjacent side surface of said central block, a horizontal, longitudinally extending base edge disposed in the same plane as the base of said central block, a work engaging edge spaced above said base edge, said work engaging edge extending longitudinally in an upward and forward direction at an inclination generally opposed to the inclination of the work supporting edge of said central block to define a vee relative thereto;

said side blocks having transversely aligned bores therein aligned with the slot in said central block, fastening means extending through said bores and said slot for releasably clamping said blocks together; and tongue and groove sliding surfaces on said central block and each of said side blocks for preventing relative rotational motion of said blocks around said fastening means and for enabling relative sliding motion between said blocks in a longitudinal direction upon loosening of said fastening means.

2. The adjustable vee blocks described in claim 1 further having a top arm for holding workpieces in the blocks, the vertical height of which arm can be manually adjusted.

3. The adjustable vee blocks described in claim 1 wherein the transversely aligned bores are comprised of three pairs of bores, two of the pairs of bores being spaced on either side of a pair of bores in the center, each pair having a smooth bore through one side block and a threaded bore in the other side block.

4. The adjustable vee blocks described in claim 1 wherein a groove is channeled into the work supporting edge in the central block to permit clearance for a tool between the bottom of the workpiece held and said work supporting edge.

5. The adjustable vee blocks described in claim 2 wherein the top arm is adjustably connected to the top of the central block by means comprising:

a horizontal top shelf in the central block extending rearwardly from the upwardmost end of the work supporting edge;

a solid projection of the central block carrying rearwardly of the block far enough to permit clearance for several screw knobs having, a threaded adjusting screw bore and a threaded locking screw bore both passing through the projection;

a top arm having a smooth bore coaxial to the threaded adjusting screw bore;

an adjusting screw used to adjust the vertical height of the top arm above the central block passing downwardly through the smooth bore in the top arm and engaging the threads in the adjusting screw bore; and a locking screw, used to lock the top arm in position, passing upwardly through and engaging threads in the locking screw bore and configured to abut the bottom of the top arm.

6. The adjustable vee blocks described in claim 3 wherein the fastening means extending through the transversely aligned bores is a manually operable screw threaded fastener.

7. The adjustable vee block described in claim 5 wherein an arc shaped groove in the bottom of the top arm adjacent the locking screw permits the top arm to be positioned other than in line with front-rear axis of the adjustable vee blocks while the groove prevents the top arm from rotating to a position such that it would not be in contact with the workpiece held.

8. A free standing vee block clamp having front and rear ends for holding an item comprising:

a central vee block having a horizontal base edge and two upper edges, forming with the base edge a triangular shape, the frontmost of the upper edges capable of engaging and supporting the item to be held;

a set of side vee blocks each having horizontal base edges coplanar with the central block's base edge and each having two upper edges forming a triangular shape with the base edge, the rearmost of the edges of each block capable of engaging and supporting the item to be held such that the engaging edges of the side blocks define a vee with the engaging edge of the central block;

fastening means capable of holding the blocks fixedly engaged to each other in any one of a plurality of locations;

an adjustable top support connected to one of the blocks capable of providing vertical positioning of the item to be held and of keeping the item within and engaged against the engaging edges of the central and side vee blocks;

a set of horizontal channels, one in each of the vertical triangular sides of the central block;

a protrusion from one of the vertical sides of each side block, the protrusion being capable of engaging one channel in the central block and holding the blocks in alignment and being sized to permit sliding movement between the blocks while the protrusion is engaged in the channel;

a horizontal slot in the central block through which the fastening means can pass, and along which the fastening means can be located; and a plurality of bores in the side blocks capable of engaging and holding the fastening means.

9. Adjustable vee blocks for holding a workpiece, comprising:

a plurality of blocks each having, flat parallel side surfaces each extending in a vertically and longitudinally extending plane, a horizontal, longitudinally extending base edge, a work supporting edge spaced above said base edge and extending upwardly in a longitudinally inclined direction, and a longitudinally extending horizontal slot adjacent and parallel to said base edge extending transversely therethrough;

said plurality of blocks being arranged in a laminated stack with their work supporting edges facing alternately in forward and rear directions to define a generally vee shaped support surface for workpieces, and their slots horizontally aligned with each other; and fastening means extending through said slots for releasably clamping said blocks together, said fastening means including means for constraining said blocks for aligned horizontal sliding motion with respect to each other upon loosening of said fastening means.

10. The adjustable vee blocks of claim 9 wherein said fastening means comprises a threaded fastener having a shank of noncircular cross section for nonrotational sliding reception through said slots of said blocks, and a nut for threaded reception over said threaded fastener for releasably clamping said blocks together, said shank of said threaded fastener preventing relative rotation of said blocks with respect to each other.

11. The adjustable vee blocks of claim 9 wherein said plurality of blocks comprises a plurality of first blocks formed from a relatively hard surface material and a plurality of second blocks formed from a relatively soft surface material, said plurality of first and second blocks being adjustable with respect to each other upon loosening of said fastening means for movement to a first configuration wherein said support surface is defined by the work supporting edges of said first and second blocks, a second configuration wherein said support surface is defined solely by the work supporting edges of said first blocks, and a third configuration wherein said support surface is defined solely by the work supporting edges of said second blocks.

12. The adjustable vee blocks of claim 11 wherein said first and second blocks each comprise a generally rectangular base defining said base edge, said base of said second blocks being slightly shorter than said base of said first blocks, and a generally triangular shaped body extending upwardly from said base defining said work supporting edge.

13. The adjustable vee blocks of claim 12 wherein said first and second blocks are arranged in an alternating stack to provide said support surface with alternating hard and soft work supporting edges facing in the forward direction, and alternating hard and soft work supporting edges facing in the rear direction, the opposite ends of said support surface being defined by the hard work supporting edges.

14. The adjustable vee blocks of claim 9 wherein each of said blocks includes along said slot at least one generally circular enlargement, said fastening means comprising a threaded fastener having a threaded portion of circular cross section for reception through said enlargement and a shank of noncircular cross section for nonrotational sliding reception into said slot.

15. Adjustable vee blocks for holding a workpiece, comprising:

a plurality of first blocks formed from a relatively hard material, each of said first blocks having a generally rectangular base with an elongated horizontally extending slot formed therein, and a body extending upwardly from said base to define an upwardly inclined work supporting edge;

a plurality of second blocks formed from a relatively soft material, each of said second blocks having a generally rectangular base with an elongated horizontally extending slot formed therein and a length slightly different from the lengths of said bases of said first blocks, and a body extending upwardly from said base to define an upwardly inclined work supporting edge substantially identical in geometry to said work supporting edges of said first blocks;

said pluralities of first and second blocks being arranged in a laminated stack with their respective work supporting edges facing alternately in forward and rear directions to define a generally vee shaped support surface having a forward side and a rear side, said forward and rear sides each being defined by an alternating arrangement of said first and second blocks with a pair of said first blocks being at opposite ends thereof; and fastening means extending through said slots for releasably clamping said stack of first and second blocks together, said fastening means including means for preventing relative rotation of said first and second blocks with respect to each other and for constraining said first and second blocks to horizontal sliding motion upon loosening of said fastening means.

16. The adjustable vee blocks of claim 15 wherein the bases of said second blocks are each formed to be slightly shorter than the bases of said first blocks.

17. The adjustable vee blocks of claim 15 wherein said fastening means comprises a threaded fastener having a shank of noncircular cross section for nonrotational sliding reception through said slots of said first and second blocks, and a nut for threaded reception over said threaded fastener for releasably clamping said first and second blocks together, said shank of said threaded fastener preventing relative rotation of said first and second blocks with respect to each other upon loosening of said nut.

18. Adjustable vee blocks for holding a workpiece comprising, a central block extending in a longitudinal direction with forward and rear ends having, flat, parallel side surfaces extending in a vertically and longitudinally extending plane, a horizontal, longitudinally extending base edge, a work supporting edge spaced above said base edge extending longitudinally in an upward and rearward direction, a longitudinally extending horizontal slot adjacent and parallel to said base edge extending transversely through said central block;

two side blocks positioned on opposite sides of said central block, each said side block having, a flat side surface in abutting contact with the adjacent side surface of said central block, a horizontal, longitudinally extending base edge disposed in the same plane as the base of said central block, a work engaging edge spaced above said base edge, said work engaging edge extending longitudinally in an upward and forward direction at an inclination generally opposed to the inclination of the work supporting edge of said central block to define a vee shaped support surface;

said side blocks having transverse openings formed therein aligned with the slot in said central block;

fastening means extending through said transverse openings in said side blocks and through said slot in said central block for releasably clamping said central and side blocks together; and means for preventing relative rotational motion of said central and side blocks with respect to each other for constraining said central and side blocks for horizontal relative sliding motion upon loosening of said fastening means.

19. The adjustable vee blocks of claim 18 wherein said means for preventing relative rotation comprise tongue and groove sliding surfaces on said central and side blocks.

20. The adjustable vee blocks of claim 18 wherein the transverse openings formed in said side blocks comprise longitudinally elongated slots, and wherein said means for preventing relative rotation comprises a shank of noncircular cross section formed on said fastening means for nonrotational reception through the slots in said central and side blocks.

* * * * *